United States Patent [19]

Shields

[11] Patent Number: 4,820,888

[45] Date of Patent: Apr. 11, 1989

[54] TILT SWITCH REPLACING MERCURY SWITCHES

[76] Inventor: Larry E. Shields, 8227 County Rd. 889, Manvel, Tex. 77578

[21] Appl. No.: 194,095

[22] Filed: May 16, 1988

[51] Int. Cl.[4] ..... H01H 35/02

[52] U.S. Cl. ..... 200/61.45 M; 200/61.52; 200/61.84; 335/205

[58] Field of Search ..... 200/61.45 R, 61.45 M, 200/61.52, 61.53, 61.84, 82 E, 81.9 M; 335/205, 207

[56] References Cited

U.S. PATENT DOCUMENTS

| | | | |
|---|---|---|---|
| 3,327,079 | 6/1967 | Widl | 200/82 E |
| 3,564,171 | 2/1971 | Hammond | 200/61.52 |
| 3,601,729 | 8/1971 | Hierta | 200/61.52 X |
| 4,166,936 | 9/1979 | Tice | 200/82 E |
| 4,484,041 | 11/1984 | Andres et al. | 200/61.45 M |
| 4,639,563 | 1/1987 | Gunther | 200/61.45 M |
| 4,705,922 | 11/1987 | Seeger et al. | 200/61.45 M |
| 4,739,135 | 4/1988 | Custer | 200/82 E X |

*Primary Examiner*—J. R. Scott

*Attorney, Agent, or Firm*—James A. Bargfrede

[57] ABSTRACT

A tilt switch encapsulated by epoxy resin in a polyvinyl chloride housing for high strength is provided. Actuation of the tilt switch is effected when moved through an arc of 45° or less.

2 Claims, 1 Drawing Sheet

TILT SWITCH REPLACING MERCURY SWITCHES

SUMMARY OF THE INVENTION

A switch which is actuated through tilting is encapsulated by epoxy resin in a polyvinyl chloride housing for high strength. The switch assembly includes a reed switch connected to two wires. Tilting of the switch assembly provides an on-off connection for use with rotary type valve actuators, control valves and any rotary or linear motion device.

DETAILED DESCRIPTION

Figure 1:
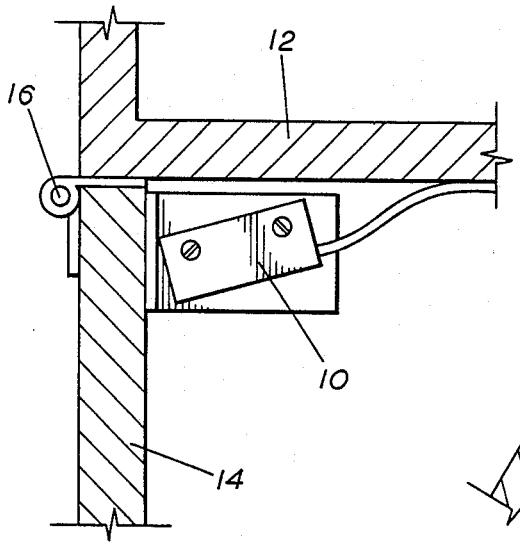
FIG. 1 is a side, elevational, partial-sectional view of an installed switch assembly of the present invention.

FIG. 1 is a side, elevational, partial-sectional view of an installed switch assembly 10 of the present invention shown positioned between member 12 and member 14 which are pivotally coupled through hinge 16. Member 12 and member 14 may be parts of a rotary type valve actuator, level switch control valve, or other device wherein on-off switching is required and which, prior to the present invention, has been achieved principally through the use of a well-known mercury switch. The switch assembly 10 shown in FIG. 1 is in an upward position relative to a horizonal plane and the switch assembly 10 is activated when moved through an arc which causes the switch assembly 10 to be below a horizonal plane as will be explained subsequently.

Figure 2:
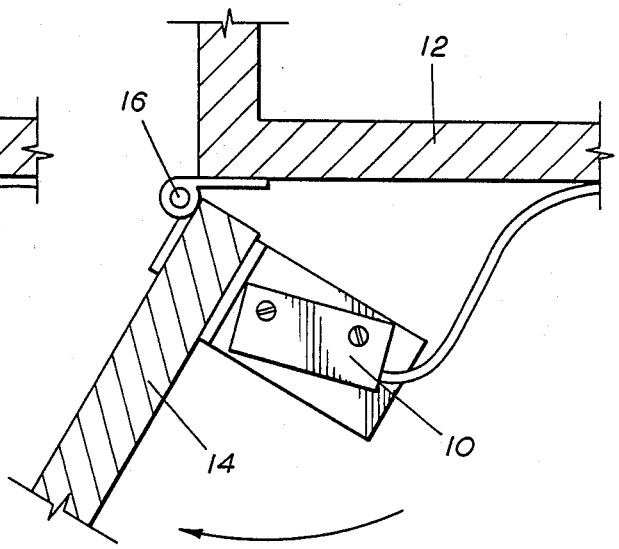
FIG. 2 is a side, elevational, partial-sectional view of the switch assembly shown in FIG. 1 but in an actuation position.

FIG. 2 is a side, elevational, partial-sectional view of the switch assembly shown in FIG. 1 but in an actuation position as mentioned previously in that the switch assembly 10 has moved below a horizonal plane when member 14 moves away from member 12 through hinge 16. Actuation of the switch assembly 10 occurs through movement in an arc of 45° or less. For example, the switch assembly 10 may be set for operation when it is about 22½° above a horizonal plane and becomes actuated through movement in an arc approximately 22½° below such horizonal plane.

Figure 3:
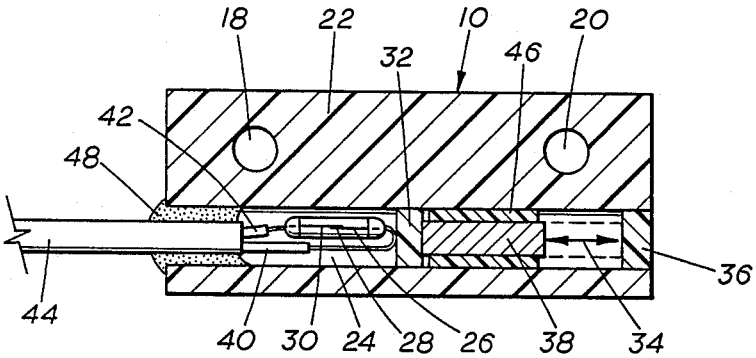
FIG. 3 is a side, elevational, sectional view of the switch assembly.

FIG. 3 is a side, elevational, sectional view of the switch assembly 10 showing mounting holes 18 and 20 in a polyvinyl chloride housing 22. The components of the switch are positioned in cylindrical opening 24 wherein a known reed switch 26 having contacts 28 and 30 are opened or closed through movement of plug 32 positioned in cylindrical opening 24. Plug 32 moves in the annulus 34 by gravity. Annulus 34 is sealed with a plug 36. Magnet 38 moves in the annulus 34 to actuate the contacts 28 and 30 of reed switch 26. The reed switch 26 is connected through wires 40 and 42 in sheath 44. One end of cylindrical opening 24 has sealant

48 around sheath 44 for fixedly positioning wires 40 and 42 in cylindrical opening 24.

Thus, in summarizing the description and operation of the switch assembly shown in detail in FIG. 3, it will be apparent to those skilled in the art to which the present invention pertains that a reed switch 26, well known in the art, is positioned in a cylindrical opening 24. Such cylindrical opening 24 has positioned therein plug 32 near the reed switch 26. Magnet 38 moves or slides in the annulus 34 in response to positioning of the switch assembly 10 above and below a horizonal plane as explained previously, thereby causing opening and closing of contacts 28 and 30. The magnet 38 is positioned for movement in sleeve 46 which maybe constructed, for example, of material such as teflon.

Figure 4:
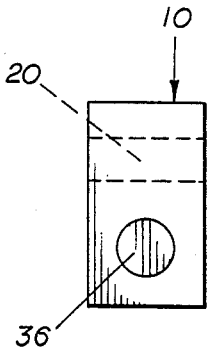
FIG. 4 is an end view of the switch assembly of FIG. 3.

FIG. 4 is an end view of the switch assembly 10 of FIG. 3 with mounting hole 20. Plug 36 is shown in FIG. 4 and it will be appreciated that plug 36 serves to seal the cylindrical opening 24 at one end.

Figure 5:
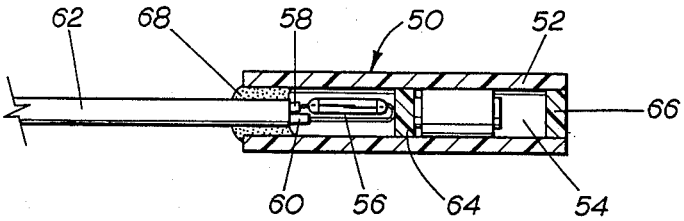
FIG. 5 is a side, elevational, sectional view of another embodiment of the switch assembly of the present invention.

FIG. 5 is a side, elevational, sectional view of another embodiment of the switch assembly of the present invention showing switch assembly 50 which includes housing 52 having a cylindrical opening 54 therein. The switch assembly 50 shown in FIG. 5 does not have mounting holes but may be installed in a variety of uses requiring limited space wherein the switch assembly of the present invention is advantageous. Reed switch 56 is positioned in cylindrical opening 54 and connected to wires 58 and 60 which are positioned in sheath 62. Plug 64 is positioned in cylindrical opening 54 and plug 66 is used to close cylindrical opening 54 at one end of the switch assembly 50. The other end of the switch assembly 50 wherein wires 58 and 60 in sheath 62 are positioned is sealed with sealant 68 as explained in connection with the switch assembly shown in FIG. 3. Thus, the switch assembly 50 shown in FIG. 5 may be utilized in those instances where space is limited but reliability and positive action are required.

Figure 6:
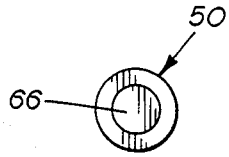
FIG. 6 is an end view of the switch assembly of FIG. 5.

FIG. 6 is an end view of the switch assembly 50 and plug 66 shown and described in connection with FIG. 5.

Thus, it will be appreciated by those skilled in the art to which the present invention pertains that a novel and useful article of manufacture has been provided characterized by replacement of conventional mercury switches with a choice of switches having high cycle-rate capability, high-speed operation, one-piece construction, corrosion resistance, and insensitivity to vibration. Simplicity is one of the hallmarks of the switching action of the switch assemblies provided by the present invention. Since the present invention is directed principally to the replacement of mercury switches, there is no mercury, no health hazard, no danger of mercury poisoning, and no adverse environmental effects.

Although preferred embodiments of the invention have been shown and described, it will be appreciated that modifications and changes may be made without departing from the spirit of the invention defined by the following claims.

I claim:

1. A tilt switch including in combination an elongated housing having a cylindrical bore, a reed switch positioned in said bore, first and second wires connected to said reed switch and extending from one end of said bore, a first plug positioned in said bore adjacent said reed switch, a magnet positioned adjacent said first plug in said bore, and a second plug positioned at the end of said bore whereby said magnet may move in said bore in response to movement of said housing upward and downward in an arc from an horizontal plane.

2. A tilt switch defined by claim 1 wherein said arc is in the range from about $22\frac{1}{2}°$ to about 45°.

* * * * *